US010876268B2

(12) United States Patent
Plotkin et al.

(10) Patent No.: US 10,876,268 B2
(45) Date of Patent: Dec. 29, 2020

(54) SCREW PILE AND DRIVE TOOL

(71) Applicant: SOLAR PILE INTERNATIONAL (HK) LTD, Sheung Wan (HK)

(72) Inventors: Kym Anthony Plotkin, Varsity Lakes (AU); Cayn Murray Plotkin, Varsity Lakes (AU)

(73) Assignee: SOLAR PILE INTERNATIONAL (HK) LTD, Sheung Wan (HK)

( * ) Notice: Subject to any disclaimer, the term of this patent is extended or adjusted under 35 U.S.C. 154(b) by 0 days.

(21) Appl. No.: 16/461,543

(22) PCT Filed: Nov. 16, 2017

(86) PCT No.: PCT/AU2017/051263
§ 371 (c)(1),
(2) Date: May 16, 2019

(87) PCT Pub. No.: WO2018/090093
PCT Pub. Date: May 24, 2018

(65) Prior Publication Data

US 2019/0292742 A1 Sep. 26, 2019

(30) Foreign Application Priority Data

Nov. 16, 2016 (AU) ..... 2016904678

(51) Int. Cl.
*E02D 5/56* (2006.01)

(52) U.S. Cl.
CPC ..... *E02D 5/56* (2013.01)

(58) Field of Classification Search
CPC .. E02D 5/56; E02D 7/22; E02D 5/526; E02D 5/801; E04H 12/2223; E04H 12/223;
(Continued)

(56) References Cited

U.S. PATENT DOCUMENTS 6,368,021 B1 * 4/2002 Strong ..... E21B 7/20 405/228
9,068,318 B1 * 6/2015 Gochis ..... E02D 5/56
(Continued)

FOREIGN PATENT DOCUMENTS

AU 2010202047 A1 5/2010
AU 2011100820 B4 8/2011
(Continued)

OTHER PUBLICATIONS

PCT International Search Report and Written Opinion of the International Searching Authority dated Feb. 23, 1988 for corresponding PCT/AU2017/051263.

*Primary Examiner* — Carib A Oquendo
(74) *Attorney, Agent, or Firm* — Renner, Otto, Boisselle & Sklar, LLP

(57) ABSTRACT

A screw pile (10) comprises a hollow elongate shaft (12), a lower portion (14) rotatably mounted to the hollow elongate shaft (12), the lower portion (14) carrying a screw or one or more blades or plates (16, 18) for screwing of the screw pile into the ground. The screw pile may have a rotatable hub located at the lower end of the shaft, a rotatable hub carrying the screw or blades (16, 18). A drive tool can engage with the rotatable hub to rotate the hub and thereby rotate the blades to screw the pile into the ground.

23 Claims, 12 Drawing Sheets

(58) Field of Classification Search
CPC ..... E21B 10/44; E21B 17/046; E21B 17/22; E21B 7/26
See application file for complete search history.

(56) References Cited

U.S. PATENT DOCUMENTS

| | | | | |
|---|---|---|---|---|
| 2011/0305527 | A1* | 12/2011 | Curic | E02D 5/36 405/271 |
| 2014/0079491 | A1* | 3/2014 | Foster | E02D 5/56 405/252.1 |

FOREIGN PATENT DOCUMENTS

| | | | |
|---|---|---|---|
| AU | 2015261689 | A1 | 6/2017 |
| JP | 6340017 | A | 2/1988 |
| JP | 6443617 | A | 2/1989 |
| WO | 2013067584 | A1 | 11/2012 |

* cited by examiner

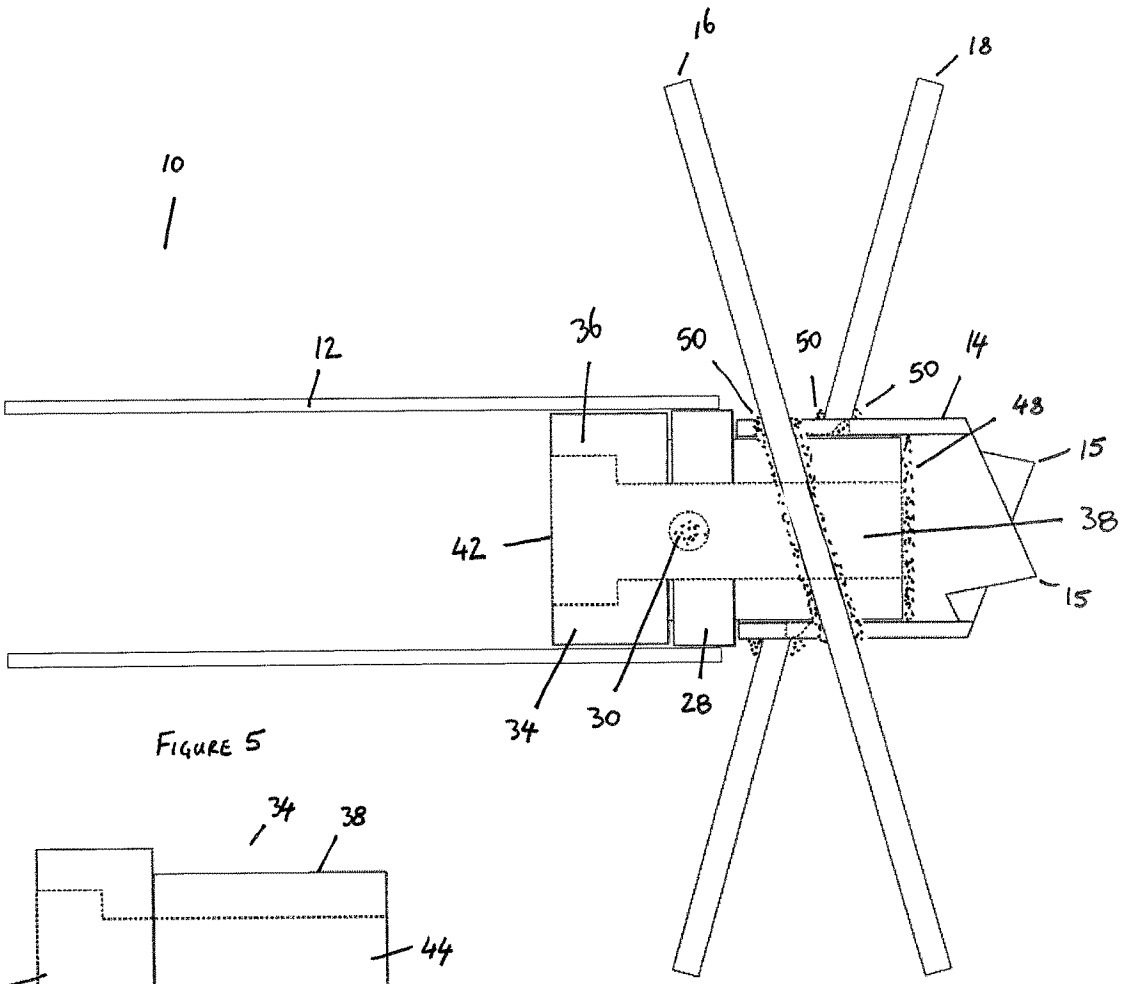
FIGURE 5
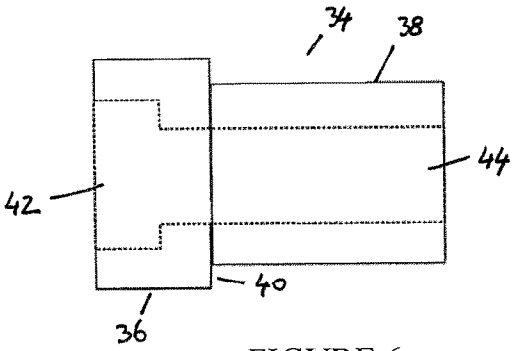
FIGURE 6
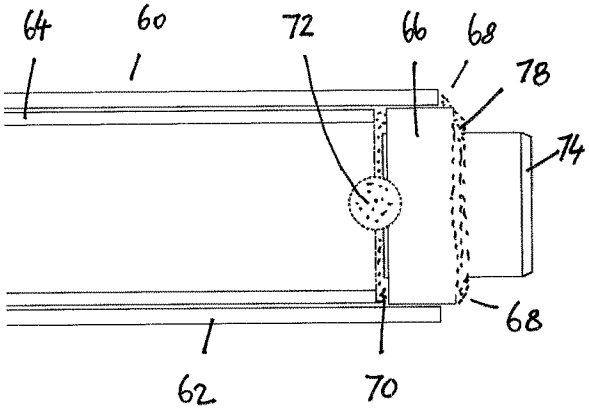

SCREW PILE AND DRIVE TOOL

This application is a national phase of International Application No. PCT/AU2017/051263 filed Nov. 16, 2017, and claims priority to Australian Application No. 2016904678 filed on Nov. 16, 2016, which is incorporated herein by reference.

TECHNICAL FIELD

The present invention relates to an improved screw pile and to a drive tool for use in installing the screw pile.

BACKGROUND ART

Screw piles are used in the construction of buildings and other structures. A typical screw pile comprises a shaft, normally made from mild steel or a higher strength steel. A helical screw or blade is attached to the shaft. In order to insert the screw pile into the ground, the screw pile is rotated and pressed downwardly which causes the helical blade to bite into the ground and to screw into the ground. Once the screw pile has been properly inserted into the ground, the weight borne by the screw pile is distributed from the helical blade into the earth that lies underneath the helical blade. Further, the earth positioned above the helical blade assists in resisting any lifting forces applied to the screw pile and thereby assists in maintaining the screw pile in the ground.

Conventional screw piles comprise a single helical blade. The blade has a leading edge that moves through and breaks the earth as the screw pile is screwed into the ground. Conventional screw piles have a leading edge on their blade that extends generally perpendicularly to the outer periphery of the blade (when viewed from above). As the shaft is normally cylindrical in shape, the leading edge of the blade may be considered to extend outwardly from the shaft in the radial direction.

Australian patent application number 2010202047 and Australian innovation patent number 2011100820, the entire contents of which are herein incorporated by cross-reference, describe a screw pile comprising a shaft, at least two blades extending outwardly from the shaft, each blade having a leading edge that contacts earth as the screw pile is screwed into the ground, the leading edge including at least a portion extending in a direction that is non-perpendicular to an outer periphery of the shaft (when viewed from above).

Alternatively, the screw pile described in that patent application and innovation patent comprises a screw pile comprising a shaft, at least two blades extending outwardly from the shaft, each blade having a leading edge that contacts earth as the screw pile is screwed into the ground, the leading edge including a swept back portion adapted to deflect rocks that come into contact with the swept back portion of the leading edge during insertion of the screw pile into the ground. The screw pile may comprise two blades in the form of angled plates. The angled plates may be mounted to the shaft. The angled plates may be mounted to the shaft, for example, by welding. Alternatively, the angled plates may be integrally formed with the shaft. The angled plates may be generally flat angled plates. The angled plates may have opposite pitch to each other. For example, when viewed from side on, one angled plate may extend downwardly from left to right while the other angled plate may extend downwardly from right to left.

Using angled blades instead of a helical screw makes manufacture of the screw pile more simple. Further, each angled blade counteracts the forces applied by the other angled blade during insertion of the screw pile, thereby resulting in the screw pile being easier to install.

Large-scale solar energy installations typically comprise a number of solar photovoltaic cells or solar collectors (such as solar collectors that are used to heat water to produce steam). In some solar energy installations, the solar photovoltaic cells or solar collectors track the sun during the day in order to maximise the amount of solar energy collected. In order to achieve this, some installations mount a number of solar photovoltaic cells or solar collectors to large drive beams and the drive beams are slowly rotated during the day to track the movement of the sun. The drive beams and associated structure must be firmly mounted in the ground a number of locations in order to firmly support the drive beam to stop or minimise distortion of the drive beam during use. Most large-scale solar energy installations mount the supporting structure for the drive beams to concrete foundations.

It will be clearly understood that, if a prior art publication is referred to herein, this reference does not constitute an admission that the publication forms part of the common general knowledge in the art in Australia or in any other country.

Throughout this specification, terms such as "upper", "lower", "top", "bottom", "above", and "below" shall be used to denote positions or locations relative to an installed position of the screw pile or relative to the screw pile being in a vertical orientation and ready for installation.

SUMMARY OF INVENTION

The present invention is directed to a screw pile. In some embodiments, the screw pile may be used in solar energy installations or in other construction uses. The present invention also relates to a drive tool for installing screw piles in accordance with the invention.

In a first aspect, the present invention provides a screw pile comprising a hollow elongate shaft, a lower portion rotatably mounted to the hollow elongate shaft, the lower portion carrying a screw one or more blades or plates for screwing of the screw pile into the ground.

In a second aspect, the present invention provides a screw pile comprising a hollow shaft, a member being located below the hollow shaft, the member having a screw, one or more blades or one or plates attached thereto, the member being rotatable relative to the hollow shaft, the screw pile being arranged such that the member cannot be removed from the hollow shaft, the screw pile being arranged such that the member cannot be removed from the screw pile by pulling the member away from the hollow shaft.

In the first and second aspects of the present invention, the hollow elongate shaft may comprise a shaft having a shape of a polygonal prism. The hollow that shaft may comprise a square hollow section rectangular hollow section. Other cross-sectional shapes may be used. The lower portion or the member being located below the hollow shaft may also have any outside shape. The lower portion or the member being located below the hollow shaft may suitably have a generally circular cross-section for at least a part of its length.

In one embodiment of the first and second aspects of the present invention, the screw pile comprises a connector, the connector being joined to the lower portion or the member being located below the hollow shaft, the connector having a portion that is retained within the hollow shaft, the connector being rotatable relative to the hollow shaft.

In some embodiments, the lower portion or the member being located below the hollow shaft may have one or more projections to sweep material away from the underside of the shaft or for removing material away from a region near an interface between the shaft and the lower portion or the member being located below the hollow shaft during insertion of the screw pile into the ground. The one or more projections may comprise one or elliptical protrusions located towards a top part of the lower portion or the member being located below the hollow shaft.

In some embodiments, the screw pile may have a hub.

In one embodiment, the hub extends below a level where the screw or one or more blades or plates are attached to the cylindrical portion.

In one embodiment, the hub is connected to the lower portion or lower member. The lower portion or lower member may comprise a cylindrical portion. The hub may be connected to the lower portion or lower member or cylindrical portion by welding. The hub may be rotated relative to the hollow shaft and it may be fixed against rotation relative to the lower portion or lower member.

In one embodiment, the hub is arranged to engage with a drive tool. The hub may have an opening that receives a drive tool. Alternatively, the hub may have a projection that is surrounded by a drive element of the drive tool. The hub may have a drive socket. The drive socket may comprise a hexagonal drive socket. Other shaped drive sockets may also be used.

In a third aspect, the present invention provides a screw pile comprising a hollow shaft having a polygonal prism shape, a cylindrical portion extending from a lower end of the hollow shaft, wherein the cylindrical portion carries a screw or one or more blades or plates to facilitate screwing of the screw pile into the ground.

In one embodiment, the hollow shaft is a rectangular hollow section or a square hollow section. However, it will be appreciated that other hollow sections having a polygonal cross-sectional shape may also be used.

The hollow shaft of the present invention, in comprising a polygonal prism shape, has a plurality of flat walls or planar walls. It is believed that the flat walls or planar walls of the hollow shaft will provide more lateral geotechnical capacity due to the flat sides, when compared to normal screw piles that have cylindrical shafts.

In a fourth aspect, the present invention provides a screw pile comprising a hollow shaft having a polygonal prism shape, a cylindrical portion extending from a lower end of the hollow shaft, wherein the cylindrical portion has a screw or one or more blades or plates attached thereto to facilitate screwing of the screw pile into the ground, a hub or connector mounted within the pile, the hub or connector extending into the hollow shaft and extending into the cylindrical portion.

Throughout the remainder of this specification, the terms "lower portion" and "cylindrical portion" may be used interchangeably, it being appreciated that the lower portion may comprise a cylindrical portion of the lower portion may comprise a non-cylindrical portion.

In one embodiment, the cylindrical portion has a diameter that is less than a width of the hollow shaft.

In one embodiment, the hub may comprise a first cylindrical portion of a first diameter and a second cylindrical portion of a second diameter, the second diameter being less then the first diameter, the second cylindrical portion extending into the cylindrical portion of the pile, the first cylindrical portion being located within the hollow shaft.

In one embodiment, the hollow shaft is fitted with a plate or a member having a complementary outer shape to an inner shape of the hollow shaft, the plate or member including a generally circular opening through which at least part of the hub can extend, the plate or member being connected to the hollow shaft. In one embodiment, the plate or member is connected to the hollow shaft by welding. For the sake of brevity, hereinafter throughout this specification, including the claims, the "plate or member" will be referred to as a "plate". It will be appreciated that the plate may comprise a relatively thick plate to provide enhanced strength to the hollow shaft.

In one embodiment, the screw pile comprises a first angled blade attached to the cylindrical portion and a second angled blade attached to the cylindrical portion. In some embodiments, the blades may be as described in Australian patent application number 2010202047 and Australian innovation patent number 2011100820, or as described with reference to the screw piles disclosed in Australian patent application number 2010217205, the entire contents of which are here incorporated by cross-reference.

In one embodiment, each blade has an arcuate region or cut-out to enable the blades to be connected to a shaft of the screw pile, the blade comprising a first leading edge extending outwardly from the shaft, a second leading edge extending from the first leading edge and a third leading edge extending from the second leading edge, a first trailing edge extending from the shaft, a second trailing edge extending from the first trailing edge and a third trailing edge extending from the second trailing edge, and a side edge extending from the third leading edge to the third trailing edge, the trailing edges being a mirror image of the leading edges.

In one embodiment, each blade has an arcuate region or cut-out to enable the blades to be connected to a shaft of the screw pile, each blade having a cutting region comprising a first leading edge extending radially outwardly from the shaft, a second leading edge extending from the first leading edge, the second leading edge extending outwardly from the shaft and forwardly relative to a direction of rotation during insertion of the screw pile, a third leading edge extending from the second leading edge, the third leading edge extending outwardly from the shaft and rearwardly relative to a direction of rotation during insertion of the screw pile, the blade further including a trailing region comprising a first trailing edge extending radially outwardly from the shaft, a second trailing edge extending from the first trailing edge, the second trailing edge extending outwardly from the shaft and rearwardly relative to a direction of rotation of the screw pile during insertion, and a third trailing edge extending from the second trailing edge, the third trailing edge extending outwardly from the shaft and forwardly relative to the direction of rotation of the screw pile during insertion, and a side edge extending between the third leading edge and a third trailing edge.

In a preferred embodiment of the present invention, the screw pile comprises a hollow shaft having a polygonal prism shape and a lower cylindrical portion extending below a lower end of the hollow shaft, a plate having a complementary outer shape to an inner shape of the hollow shaft, the plate being joined to the hollow shaft at a lower end of the hollow shaft, the plate including a generally circular opening through which a hub can extend, the hub comprising a first cylindrical portion having a first diameter and a second cylindrical portion having a second diameter, the second diameter being smaller than the first diameter, the second cylindrical portion of the hub extending through the circular opening in the plate, the first cylindrical portion of the hub being positioned above the plate, the second cylindrical portion being joined to the cylindrical portion of the screw pile, the hub being arranged to engage with a drive tool, the cylindrical portion of the screw pile having a screw or one or more blades or one or plates attached thereto.

In one embodiment, the hub can rotate relative to the plate. In this way, rotation of a drive tool that is engaged with the hub causes the lower cylindrical portion of the screw pile and the screw, blades or plates attached thereto to rotate. This causes the screw or blades or plates to screw into the ground. As the hub can rotate relative to the plate that is attached to the lower end of the hollow shaft of the screw pile, the hollow shaft having the polygonal prism shape does not necessarily have to rotate with the rotation of the lower cylindrical portion that is caused by rotation of the drive tool. Consequently, as the drive tool is rotated, the lower cylindrical portion with the screw, blades or plates rotates into the ground and this acts to pull the hollow shaft having the polygonal prism shape down into the ground with it. The hub has a first cylindrical portion of larger diameter than the second cylindrical portion and as a result, the second cylindrical portion bears on the plate. As the plate is securely attached to the lower end of the hollow shaft, as the screw, blades or plates are screwed into the ground, the hub bears upon the plate and forces the hollow shaft having the polygonal prism shape into the ground. The hollow shaft can effectively be pulled directly downwardly into the ground by the rotation of the screw, blades or plates caused by rotation of the drive tool. In this embodiment, the hollow section shaft of the screw pile does not rotate during insertion of the hollow section into the ground during installation of the screw pile.

In one embodiment, a small gap is provided between an upper end of the lower cylindrical portion and the lower end of the plate, and wherein the lower cylindrical portion has a diameter that is larger than the second diameter such that an upper end of the lower cylindrical portion has walls that are positioned radially outwardly from the opening in the plate. In this arrangement, the walls of the lower cylindrical member will come into contact with the plate if the lower cylindrical member is pushed towards the hollow shaft having the polygonal prism shape.

In this aspect of the present invention, the hollow shaft may be of any cross sectional shape. Preferably, the hollow shaft is a rectangular hollow section or a square hollow section. The member is suitably a cylindrical member.

In some embodiments, the screw pile includes one or more stabilising wings extending generally radially or transversely outwardly from the pile shaft. The stabilising wings may be mounted to a sleeve that is received on the hollow shaft. Alternatively, the stabilising wings may simply be welded to the hollow shaft. In one embodiment, the wings are welded along one face of the hollow shaft.

The stabilising wings may be in the form of plates extending in a direction that is generally transverse to the pile shaft. The stabilising wings may have lower edges that extend at an acute angle to the longitudinal axis of the pile shaft, thereby assisting penetration of the leading edge of the stabilising wings into the ground.

A plurality of stabilising wings may be provided. In particular, stabilising wings may be provided in sets of two, three or four stabilising wings equiangularly spaced around a periphery of the pile shaft.

In some embodiments, the upper edges of the stabilising wings are located no higher than the upper end of the shaft of the screw pile. In other embodiments, the stabilising wings are arranged such that the upper edges of the wings are located at least 100 mm, preferably from 100 mm to 500 mm, more preferably about 200 mm, below ground level when the screw pile is installed into the ground.

In one embodiment, the hollow shaft having the polygonal prism shape forms the bulk of the length of the screw pile.

In some embodiments, a bit or a rock attack section may be formed on or joined to a lower part of the cylindrical section or lower member of the screw pile. This can be advantageous if the screw pile is to be used in rocky ground for hard ground. The bit or rock attack section can assist in breaking through rocky ground or hard ground during installation of the screw pile. In some embodiments, the bit or rock attack section may comprise two tips or an even number of tips. The tips may be diametrically opposed to each other. In this manner, when a pile is ready to be inserted into the ground, the pile is placed in a vertical orientation and moved into contact with the ground. By having two tips (or an even number of tips), the pile is more likely to remain in a vertical orientation at this stage of installation, which assists in maintaining the correct orientation and desired tolerances for placement of the pile during installation.

In one embodiment, the bit may comprise a central pyramidal region and a plurality of cutting teeth. The plurality of cutting teeth may be located radially outwardly from the central pyramidal region. The plurality of cutting teeth may comprise an even number of cutting teeth.

In embodiments of the present invention, the plate is joined to a lower end of the hollow shaft. The plate may be at least partially inserted into the lower end of the hollow shaft and subsequently joined to the hollow shaft. The hub or connector may at least partially pass through the plate and into the lower cylindrical portion. The hub or connector is joined to the lower cylindrical portion but is rotatable relative to the hollow shaft. The plate strengthens or reinforces the lower end of the hollow shaft. The hub or connector can engage with a drive tool such that a rotational force (torque) applied by the drive tool passes through the hub or connector to thereby cause rotation of the screw, blades or plates to thereby screw the screw pile into the ground. The hub or connector can be made from very strong materials such that high torque loads can be transmitted through the hub or connector by the drive tool. In this manner, the installation torque that is applied by the drive tool is applied to the hub or connector at a location that is very close to the screw, blades or plates of the screw pile. This will allow high torque loads to be applied during installation. The only parts of the screw pile that rotates during installation in this embodiment are the screw, blades or plates, the lower cylindrical portion and the hub or connector. The main shaft of the screw pile is simply pulled directly into the ground by the action of the screw, blades or plates being screwed into the ground. The main shaft of the screw pile does not have to rotate in order to install the screw pile into the ground.

In some embodiments, the screw pile has a conventional helical screw to facilitate screwing of the screw pile into the ground. In other embodiments, the screw pile is provided with screw blades. The screw pile may comprise two blades in the form of angled plates. The angled plates may be mounted to the shaft. The angled plates may be mounted to the shaft, for example, by welding. Alternatively, the angled plates may be integrally formed with the shaft. The angled plates may be generally flat angled plates. The angled plates may have opposite pitch to each other. For example, when viewed from side on, one angled plate may extend downwardly from left to right while the other angled plate may extend downwardly from right to left. The blades may be as described in Australian patent application number 2010202047 and Australian innovation patent number 2011100820. More than one set of blades may be provided on each pile shaft, for example as described in international patent publication number WO 2013/067584, the entire contents of which are incorporated herein by cross-reference.

The present invention also relates to a drive tool for use with a screw pile as described herein. According to a further aspect, the present invention provides a drive tool comprising a torque tube, a drive block ring located at an end of the torque tube, and a drive block attached to or formed with the drive block ring, the drive tool including one or more drive lugs for engagement with a rotational drive.

In one aspect, the drive tool comprises an outer tube having drive lugs attached to or formed thereon, an inner high torque tube fixedly mounted in the outer tube, a drive block ring located at an end of the inner high torque tube, and a drive block attached to or formed with the drive block ring. In another embodiment, the drive tool may comprise a torque tube having the drive lugs attached to or formed thereon. In this embodiment, it may not be necessary to include the outer tube.

In one embodiment, the drive block ring abuts against an end of the inner high torque tube and is located at least partially inside the outer tube, the drive block ring being joined to the end of the inner high torque tube and joined to the outer tube. The drive block ring may be joined to the outer tube and the inner high torque tube by welding. The drive block may comprise a drive block that is welded to the drive block ring. The outer tube may comprise an outer cylindrical tube.

In embodiments where the outer tube is not required, the drive block ring may be joined to the torque tube by welding. The drive block ring may be partly inserted into the torque tube and weld metal applied around the periphery of the junction between the end of the torque tube and the drive block ring.

The design of the drive tool allows the strength and torque rating of the torque tube and the drive block ring to be designed to suit the particular torque load that is desired to be applied by the drive tool. The outer tube suitably has an outer dimension that enables it to be inserted into and rotate within the hollow main shaft of the screw pile. The drive tool is suitably of a length that is longer than the length of the main shaft of the screw pile such that the drive lugs are located above a top of the screw pile when the drive tool is positioned inside the screw pile in a driving position.

Any of the features described herein can be combined in any combination with any one or more of the other features described herein within the scope of the invention.

The reference to any prior art in this specification is not, and should not be taken as an acknowledgement or any form of suggestion that the prior art forms part of the common general knowledge.

BRIEF DESCRIPTION OF DRAWINGS

Various embodiments of the invention will be described with reference to the following drawings, in which:

FIG. 5 shows a cross sectional side view of a lower portion of the screw pile shown in FIG. 1 with a drive tool being readied for engagement with a hub or connector;

FIG. 6 shows a side view of a hub or connector used in the screw pile shown in FIG. 5;

DESCRIPTION OF EMBODIMENTS

Those skilled in the art will understand that the drawings have been provided for the purpose of illustrating preferred embodiments of the present invention. Therefore, it will be understood that the present invention should not be considered to be limited solely to the features as shown in the attached drawings.

Figure 1:
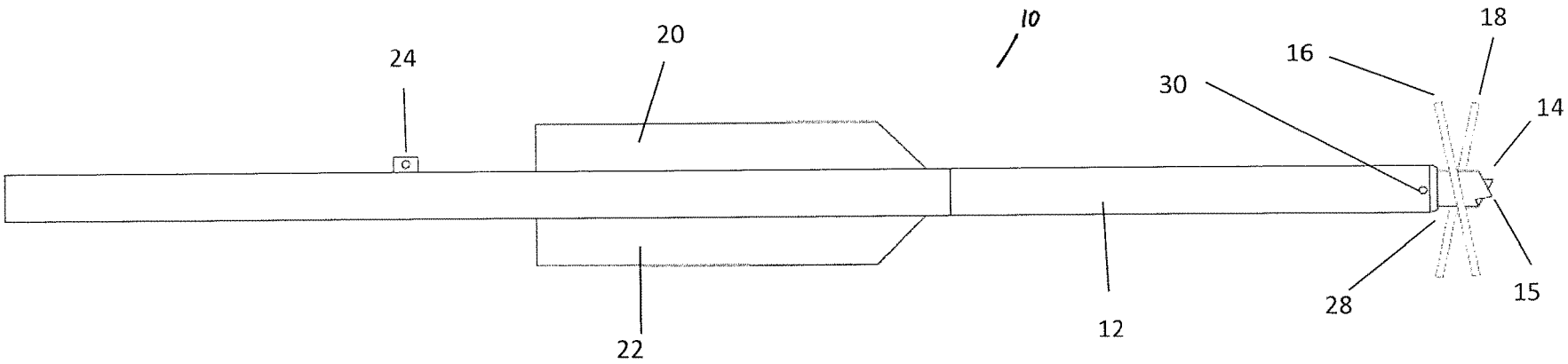
FIG. 1 shows a side view of a screw pile in accordance with an embodiment of the present invention.

FIG. 1 shows a screw pile 10 in accordance with one embodiment of the present invention. The screw pile 10 includes a main shaft 12, which is in the form of a steel square hollow section (SHS). It will be appreciated that the square hollow section shaft 12 may be of other polygonal prism shapes, such as rectangular hollow section. The entirety of main shaft 12 may comprise the square hollow section, which is the case for the embodiment shown in FIG. 1.

The screw pile 10 includes a cylindrical member 14 that has two opposed angled blades 16, 18 welded thereto. The blades 16, 18 are used to facilitate screwing or installation of the screw pile into the ground. The lower end of the cylindrical member 14 has an attack bit 15 formed thereon or mounted thereto. The screw pile 10 further includes stabilising wings 20, 22 that extend transversely to the longitudinal axis of the main shaft 12. The screw pile 10 shown in FIG. 1 is particularly intended for use in the construction of solar farms. As such, the screw pile 10 is fitted with an earthing connector plate 24 which is designed to receive an earth strap fitment. Earthing connector plate 24 may be omitted in other applications.

In the screw pile shown in FIG. 1, the lower cylindrical member 14 can rotate relative to the main shaft 12. In this manner, the blades 16, 18 can be rotated, such as by a drive tool, during installation of the screw pile 10 into the ground whilst the square hollow section shaft 12 can simply be pulled into the ground by the blades without requiring that the square hollow section shaft 12 be rotated. The particular construction of this embodiment of the screw pile by which this can be achieved is shown in more detail with reference to FIG. 2.

Figure 2:
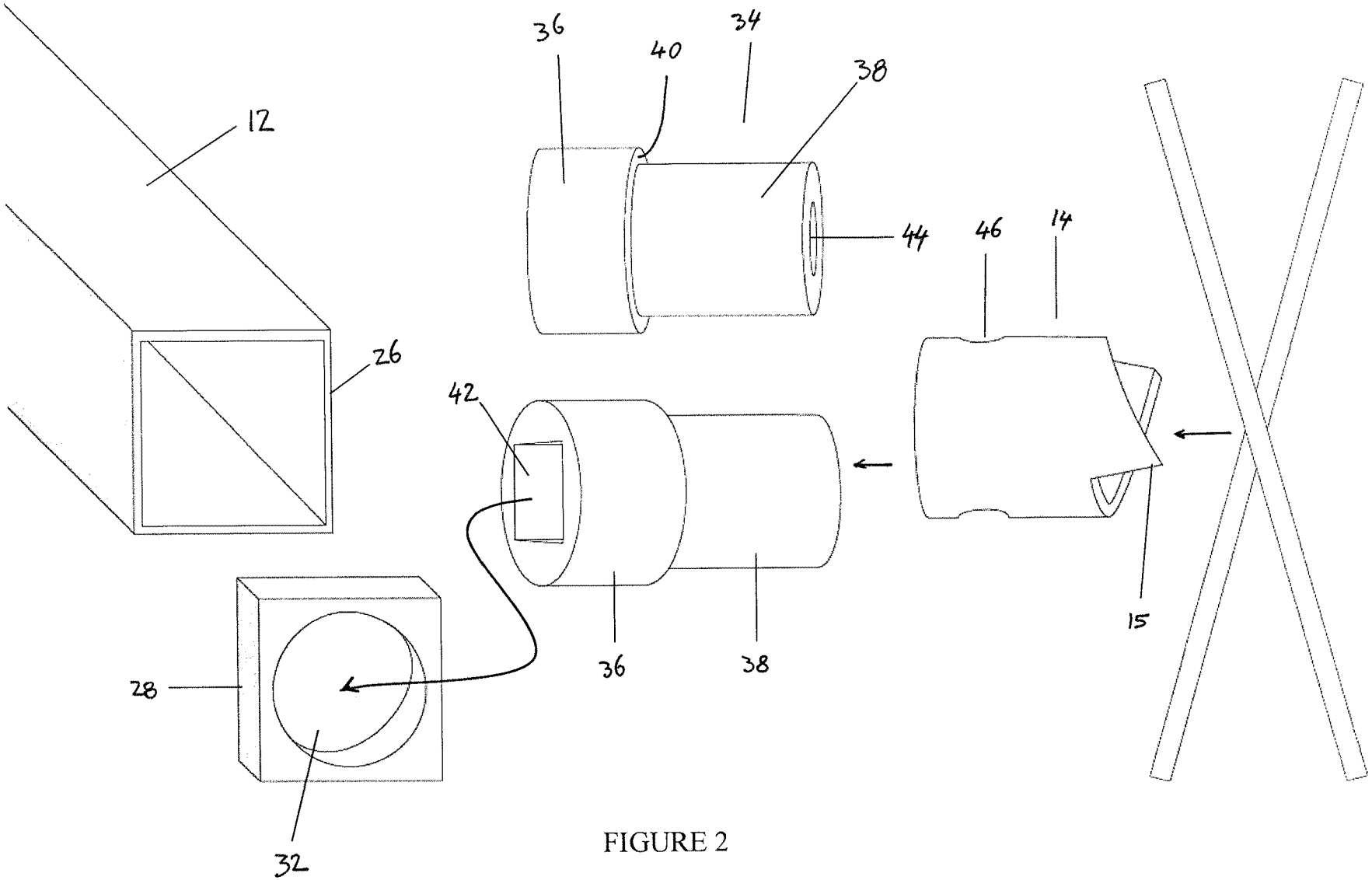
FIG. 2 shows a disassembled view of the screw pile shown in FIG. 1, with the parts in line ready for assembly.

FIG. 2 shows the various parts of the screw pile that are located near and below the lower end of the square hollow section shaft 12 of the screw pile 10. As can be seen from FIG. 2, the lower end 26 of square hollow section shaft 12 is fitted with a plate 28. Plate 28 is shaped such that is fits inside the hollow shaft 12. Plate 28 is partially inserted into the hollow shaft 12 such that a lower part of the plates 28 extends out from the hollow shaft 12 whilst the remainder of the plate 28 is located within the hollow shaft 12. As can be seen from FIG. 1, the lower part of plate 28 can be seen in the screw pile 10. The plate 28 is then welded in position. Weld metal may extend between the periphery of the plate 28 that extends out of the lower part of hollow shaft 26 and the end of the hollow shaft 12. Further, openings (not shown in FIG. 2) may be formed near the end of hollow shaft 12 and weld metal may be applied to the side faces of the plate 28 through those openings to form buttons of weld metal. One such weld button is shown at reference numeral 30 in FIG. 1.

The plate 28 may be a relatively thick plate. For example, the plate 28 may have a thickness of between 15 to 30 mm, or between 20 and 25 mm. The plate 28 may be made from heavy duty steel or from a high strength metal.

The plate 28 also has a circular opening 32. Thus, once the plate 28 has been welded in position in the end of hollow shaft 12, the opening 32 provides an entry or egress region from the hollow shaft. The opening 32 is designed such that part of a connector or hub 34 can extend through the opening 32.

The connector or hub 34 (hereinafter referred to as the hub for brevity) is suitably formed from metal, such as steel. The hub may be machined from a single piece of metal. Alternatively, the hub may be manufactured as a cast product. In either case, the hub 34 forms a strong element that can transmit significant rotational or torque forces.

The hub 34 comprises a first cylindrical portion 36 having a first diameter and a second cylindrical portion 38 having a second diameter. As can be seen from FIG. 2, the first diameter is larger than the second diameter. The second diameter 38 is just slightly smaller than the diameter of opening 32 in plate 28 such that the second cylindrical portion 38 can be inserted through the opening 32 of the plate 28. A shoulder 40 delineates the junction between the first cylindrical portion 36 and the second cylindrical portion 38. As can be seen from FIG. 2 and FIG. 6, a square recess 42 is formed in the first cylindrical portion. A cylindrical bore 44 extends from the square recess 42 through the remainder of the hub 34. The cylindrical bore 44 opens at the lower end of the hub 34. The bore 44 is provided to help improve the ability of the hub to transmit and resist rotational or torque forces.

Part of the second cylindrical portion 38 of hub 34 extends into the hollow cylindrical member 14. The hollow cylindrical member 14 is provided with a plurality of openings 46 in its outer wall. These openings allow weld metal to be deposited on the surface of second cylindrical portion 38 and the cylindrical member 14 to thereby weld the second cylindrical portion 38 to the cylindrical member 14. Further, weld metal is applied around the lower end of the second cylindrical portion 38 to thereby provide further welding of the second cylindrical portion 38 to the central member 14. This is shown as weld metal 48 in FIG. 5. It will be appreciated that the second cylindrical portion 38 of the hub 34 is strongly welded to and therefore strongly and fixedly connected to the cylindrical member 14.

FIG. 5 shows the lower end of the screw pile 10 in fully assembled form. As can be seen from FIG. 5, the lower end of the screw pile 10 includes the square hollow section shaft 12, lower cylindrical member 14 and the blades 16, 18. The blades 16, 18 are welded to the cylindrical member 14 by welds 50. The plate 28 is at least partly inserted into the square hollow section shaft 12 such that a lower part of the plate 28 extends beyond a lower end of the square hollow section shaft 12. The outer periphery of the lower portion of the plate 28 is welded to the shaft 12, leaving a deposit of weld metal 52. Weld buttons 30 further assist in welding the plate 28 to the shaft 12. The hub 34 is inserted through the opening 32 in plate 28 such that the second cylindrical portion 38 extends through opening 32 in plate 28. The first cylindrical section 36 is oversized compared to opening 32 and therefore cannot pass through the opening 32. Accordingly, shoulder 40 of hub 34 abuts on the plate 28, thereby preventing removal of the hub 34 from the shaft 12 by pulling the hub away from the shaft (by pulling the hub 34 to the right in FIG. 5).

It can be seen that the hub 34 is fixedly connected to the lower cylindrical member 14 but is able to rotate in the opening 32 of plate 28. Consequently, the hub 34 can rotate relative to the shaft 12, meaning that the lower cylindrical member 14 and the blades 16, 18 can also rotate relative to the shaft 12. As can also be seen in FIG. 5, if the cylindrical member 14 is pushed towards the shaft 12, the upper ends 54 of the central member 14 will come into contact with the plates 28, thereby preventing further movement of the hub 34 into the hollow shaft 12.

Figure 3:
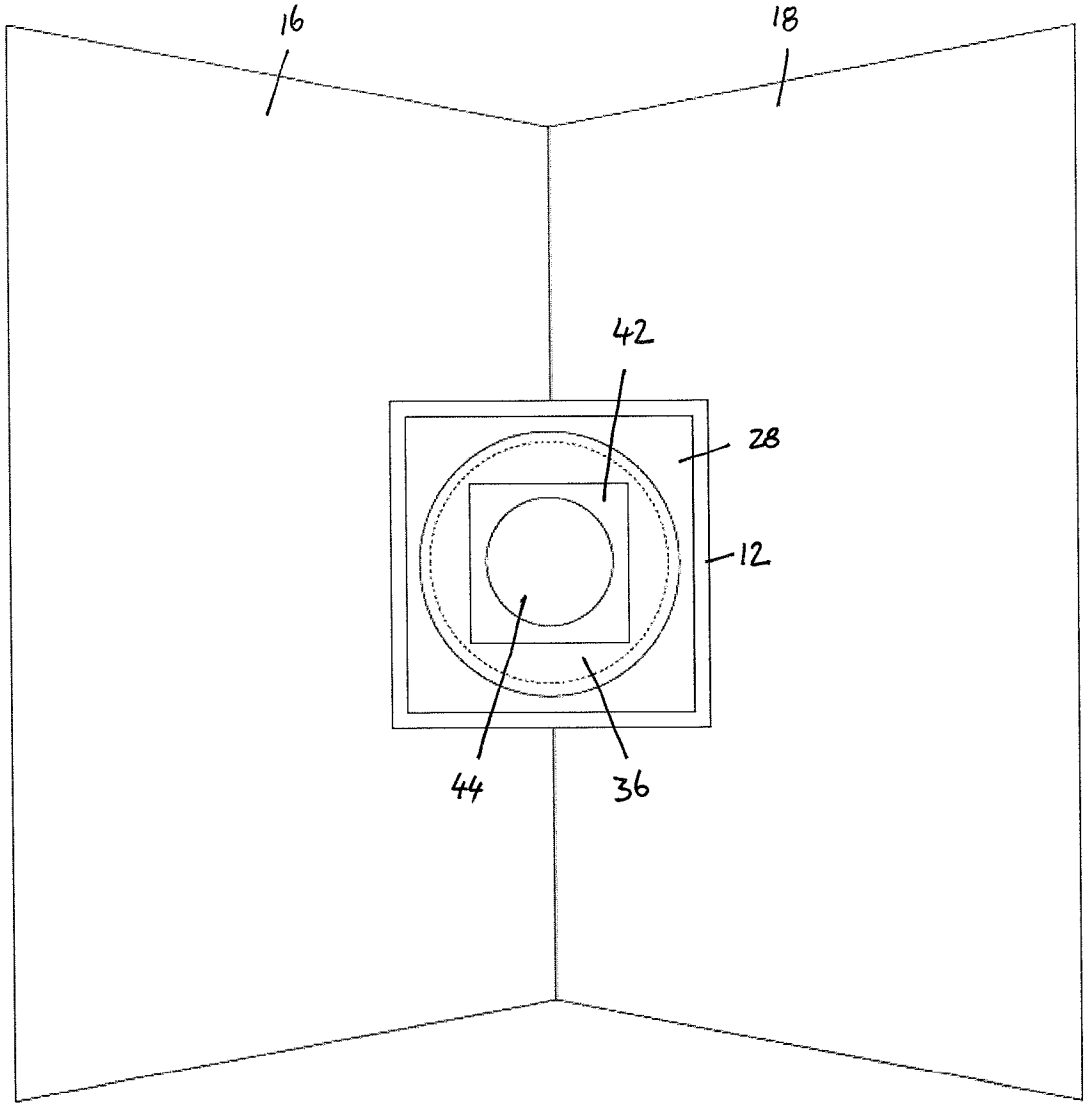
FIG. 3 shows a top or plan view of the screw pile shown in FIG. 1.
Figure 4:
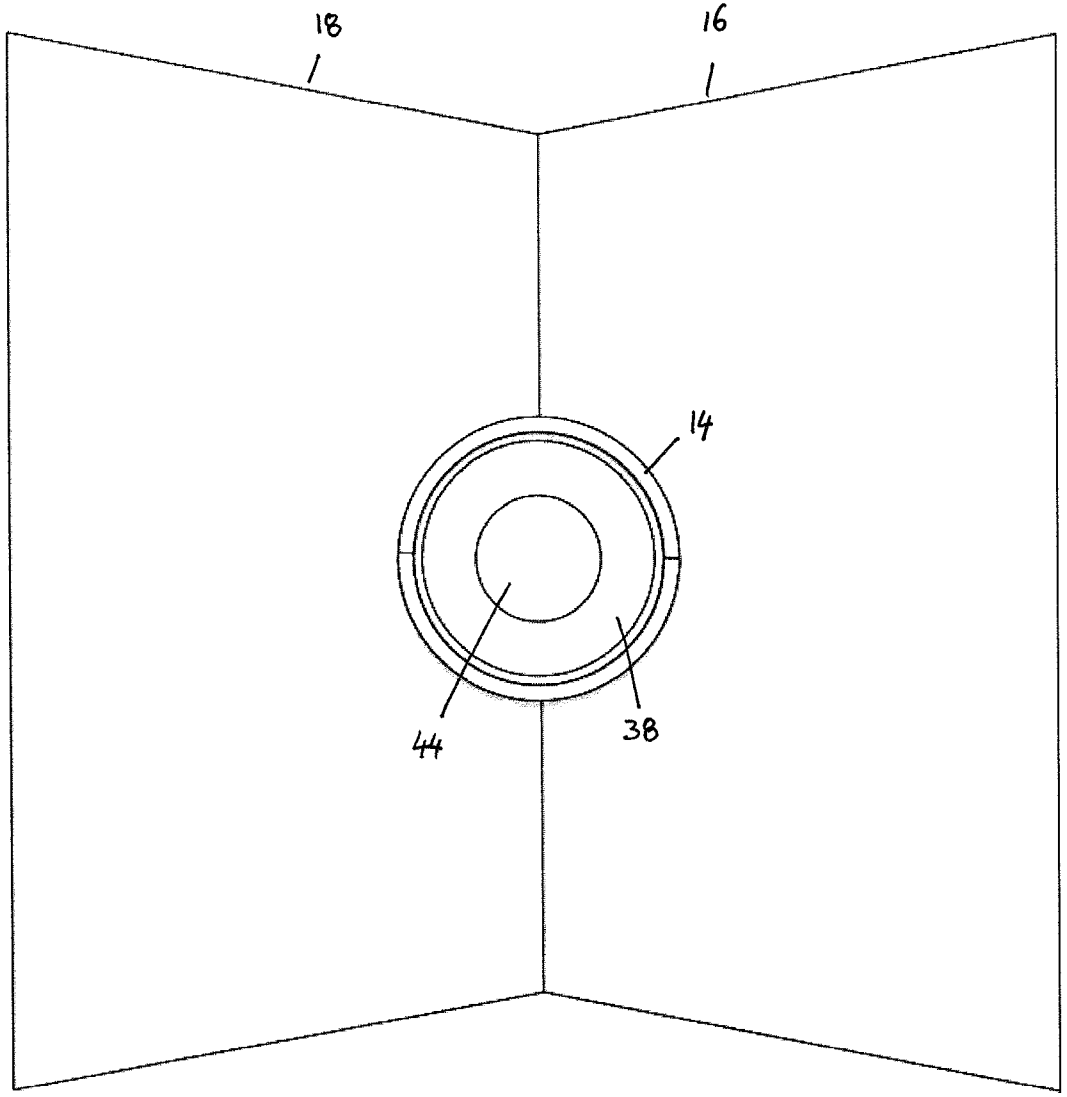
FIG. 4 shows a bottom or underneath view of a screw pile shown in FIG. 1.

FIGS. 3 and 4 show a top plan view and a bottom plan view, respectively, of the screw pile 10 shown in FIG. 1.

As the cylindrical member 14 and blades 16, 18 can rotate relative to the main shaft 12, a drive to can be engaged with the hub 34 in order to rotate the blades 16, 18. One embodiment of a suitable drive tool is shown at 60 in FIG. 5. The drive tool 60 comprises an outer cylindrical hollow section 62. An internal high torque tube 64 is positioned inside cylindrical hollow section 62 and welded thereto. In other embodiments, the outer tube may be omitted and the high torque tube may form the main shaft of the drive tool. A drive block ring 66 is positioned inside outer cylindrical hollow section 62 and welded by welds 68 to the outer cylindrical hollow section 62 and welded by welds 70 to the end of internal high torque tube 64. Button welds 72 are used to further weld the outer cylindrical hollow section 62 to the internal high torque tube 64 and the drive block ring 66. A drive block 74, which is in the shape of a square prism block or rectangular prism block, is positioned inside an appropriately shaped recess 76 in drive block ring 66 and welded in place using weld metal 78. The recess 76 may extend all the way through drive block ring 66. The drive block 74 is sized and shaped such that it snugly fits inside square recess 42 in hub 34.

Figure 7:
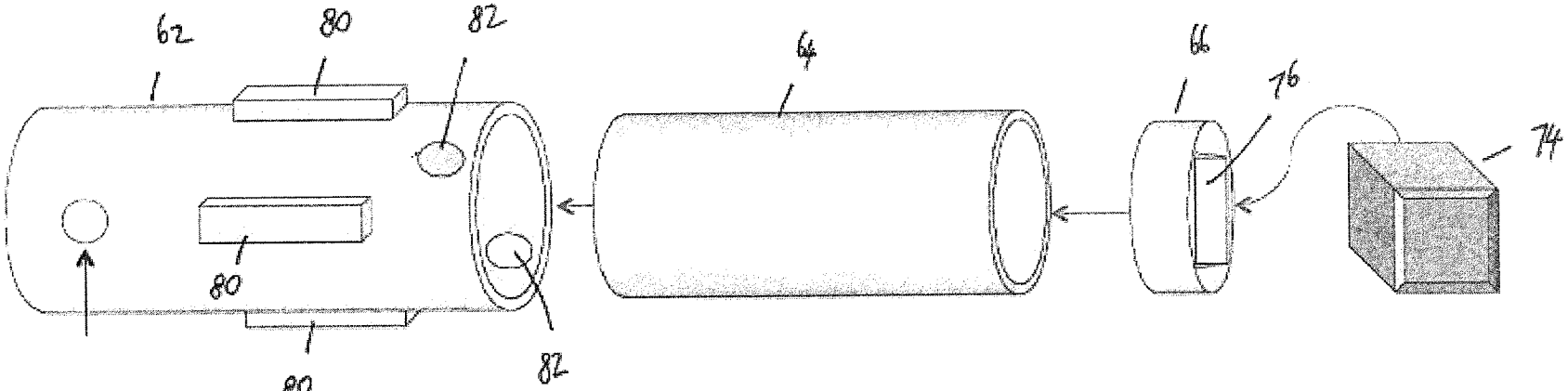
FIG. 7 shows a side view, apart and in line for assembly, of one form of a drive tool suitable for installing screw piles in accordance with the present invention.
Figure 8:
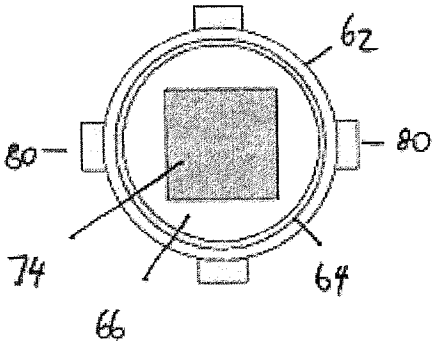
FIG. 8 shows a top end view of the drive tool shown in FIG. 7.
Figure 9:
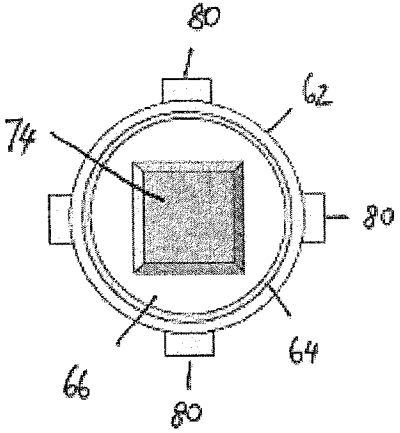
FIG. 9 shows a bottom end view of the drive tool shown in FIG. 7

FIG. 7 shows the components of the drive tool 10 separated but in line for assembly. As can be seen from FIG. 7, the outer cylindrical hollow section 62 also includes drive lugs 80 and button weld holes 82 which allow button welds 72 to be made. FIG. 8 shows a top view of the drive tool 60. FIG. 9 shows a bottom view of the drive tool 60.

The drive tool 60 is suitably of a length that is slightly longer than the length of the main shaft 12 of the screw pile 10 such that the drive lugs 80 extend past the top of the main shaft 12. This enables the drive tool 60 to be rotated by an external drive that engages with the drive lugs 80. It will be appreciated that the outer diameter of the outer cylindrical hollow section 62 of drive tool 60 is sufficiently small so that it fits inside the square hollow section shaft 12.

In order to install a screw pile 10 into the ground, the screw pile 10 is raised to a vertical orientation. The drive tool 60 is inserted into the square hollow section shaft 12 until the drive block 74 is inserted into the recess 42 on the hub 34. A rotating drive may then be applied via the drive lugs 80 to the drive tool 60, which causes the hub 34 to rotate. As the cylindrical member 14 and the plate 16, 18 are effectively fixed in position relative to the second cylindrical portion 38 of the hub 34, rotation of the hub 34 causes rotation of the blade 16, 18. This causes the blades to bite into the ground and to be drawn into the ground. As the blades are drawn into the ground, the hub 34 is pulled downwardly. As the hub 34 is pulled downwardly, the shoulder 40 of hub 34 contacts plate 28. Therefore, as the hub 34 is pulled downwardly by the rotation of the blades, the hub 34 also acts to pull the main shaft 12 downwardly. However, as the hub 34 can rotate relative to the main shaft 12, the main shaft 12 is pulled into the ground without the main shaft 12 being caused to rotate. Operation of the drive tool continues until the screw pile 10 has been installed to a desired depth in the ground. The drive tool 60 may then be lifted vertically to remove the drive tool 60 from the main shaft 12 of the screw pile 10. In some installations, various tools or manual techniques may be utilised to ensure that the shaft remains in a vertical orientation during installation. This is particularly important in applications where tight tolerances are required in the position of the installed pile, such as in installations where the installed piles are used to support solar arrays.

As mentioned above, during installation, the main shaft of the screw pile is effectively pulled into the ground without rotation. The main shaft of the screw pile is pulled through the soil or earth that has been disturbed by the rotating blades during installation. It is believed that moving the main shaft of the screw pile downwardly through that disturbed earth will cause some displacement of that disturbed earth and help the disturbed earth settle against the outer walls of the main shaft of the screw pile.

If the screw pile 10 is to be inserted into rocky or hard ground, the attack bit 15 on the end of the cylindrical member 12 can assist in cutting through or breaking through the rocky or hard ground. As shown in the attached figures, the pile in this embodiment of the invention is provided with two diametrically opposed tips forming the attack bit section. With this arrangement, when the screw pile is placed in a vertical position and moved into contact with the ground during the initial stages of installation, the pile is less likely to tip away from the vertical orientation, meaning that the correct orientation and position of the pile is easier to maintain during installation. This is expected to improve installation tolerances.

The screw pile 10 in accordance with preferred embodiments of the present invention has a number of advantages over and above known screw piles. In the screw pile 10, the torque applied by the drive tool is applied in a location that is very close to the blades, meaning that most or all of the torque is concentrated directly at and into the blades. The present inventor believes that this should result in more rapid installation, with the screw pile having the potential to be able to far higher levels of torque than in conventional piles in which the torque load is limited by the torsional capacity of the pile shaft. The direct drive is also expected to provide a real solution for driving/breaking piles when installing into difficult gravels and rock layers.

The main shaft 12 is effectively a square tube, which is anticipated to provide more lateral geotechnical capacity compared to normal piles that have cylindrical main shafts, due to the flat sides of the tube. Further, the square hollow section tube has almost doubled the bending moment capacity of an equivalent size/weight circular or cylindrical tube, thereby providing further strength benefits.

Manufacture of the screw pile 10 is expected to be relatively simple, with the design being relatively straightforward to manufacture, thereby allowing mass production with reduced risk of faulty product. It is anticipated that this will also lead to the screw pile 10 being of relatively low cost. The screw pile 10 is expected to perform every bit as good for tension or compression loading when compared to past designs. The screw pile 10 is provided with stabilising wings 20, 22. The size and number of those wings may vary. However, it is anticipated that, due to the flat sides of the square hollow section tube that forms the main shaft of the screw pile, it should only be necessary to have two stabilising wings. In certain applications, it may not be necessary to have any stabilising wings at all.

The drive tool can be engineered to provide sufficient torque capacity by properly designing the strength of the internal high torque tube and the drive block ring. Different torque rated drive tools may be provided for use in different regions. For example, if the screw piles are to be driven into relatively soft ground, a lower torque rated tool may be provided when compared to the torque rating of a tool that may be required to drive screw piles into hard or rocky ground.

In some embodiments, the top of the screw pile may comprise an open top. The top of the screw pile can receive an open female tube (or a male tube that is inserted into the open top of the screw pile shaft) having a top plate that is adapted to fit with a connection system. In this manner, if different connection systems are used across different applications, it is simple matter to simply place a different top plate on the top of the tube. The female tube (or male tube) and top plate can be connected to the top of the screw pile, for example, by bolting or rivets.

Figure 10:
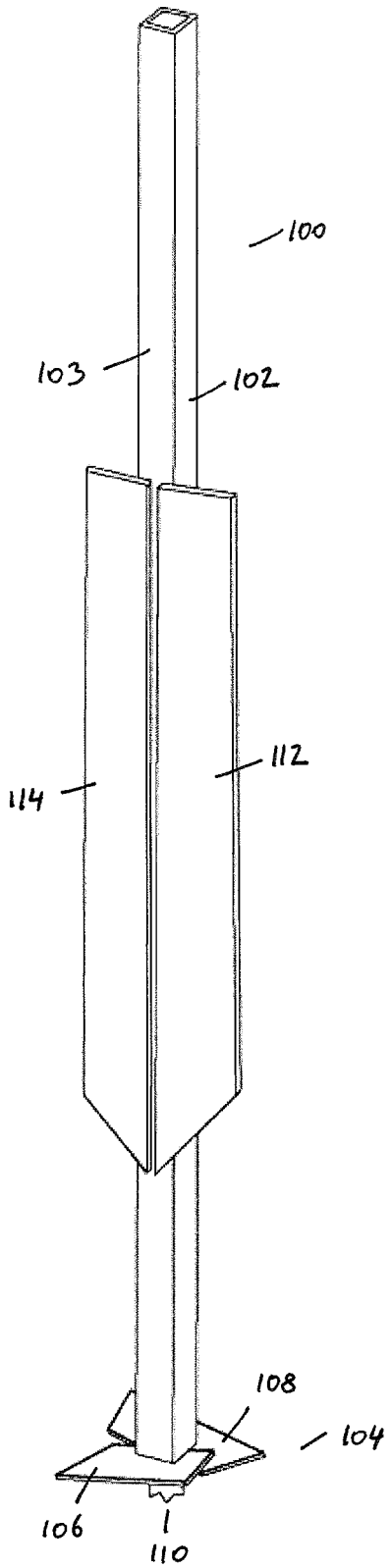
FIG. 10 shows a perspective view of a screw pile in accordance with a further embodiment of the present invention.
Figure 11:
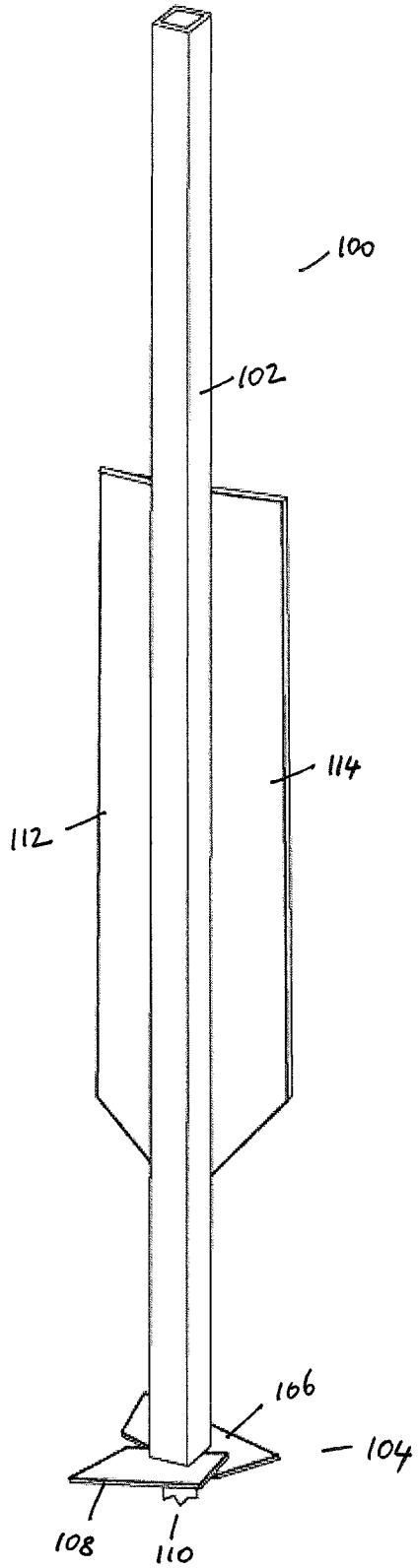
FIG. 11 shows a perspective view of the screw pile shown in FIG. 10, with the view in FIG. 11 being from an opposite side of the screw pile.
Figure 12:
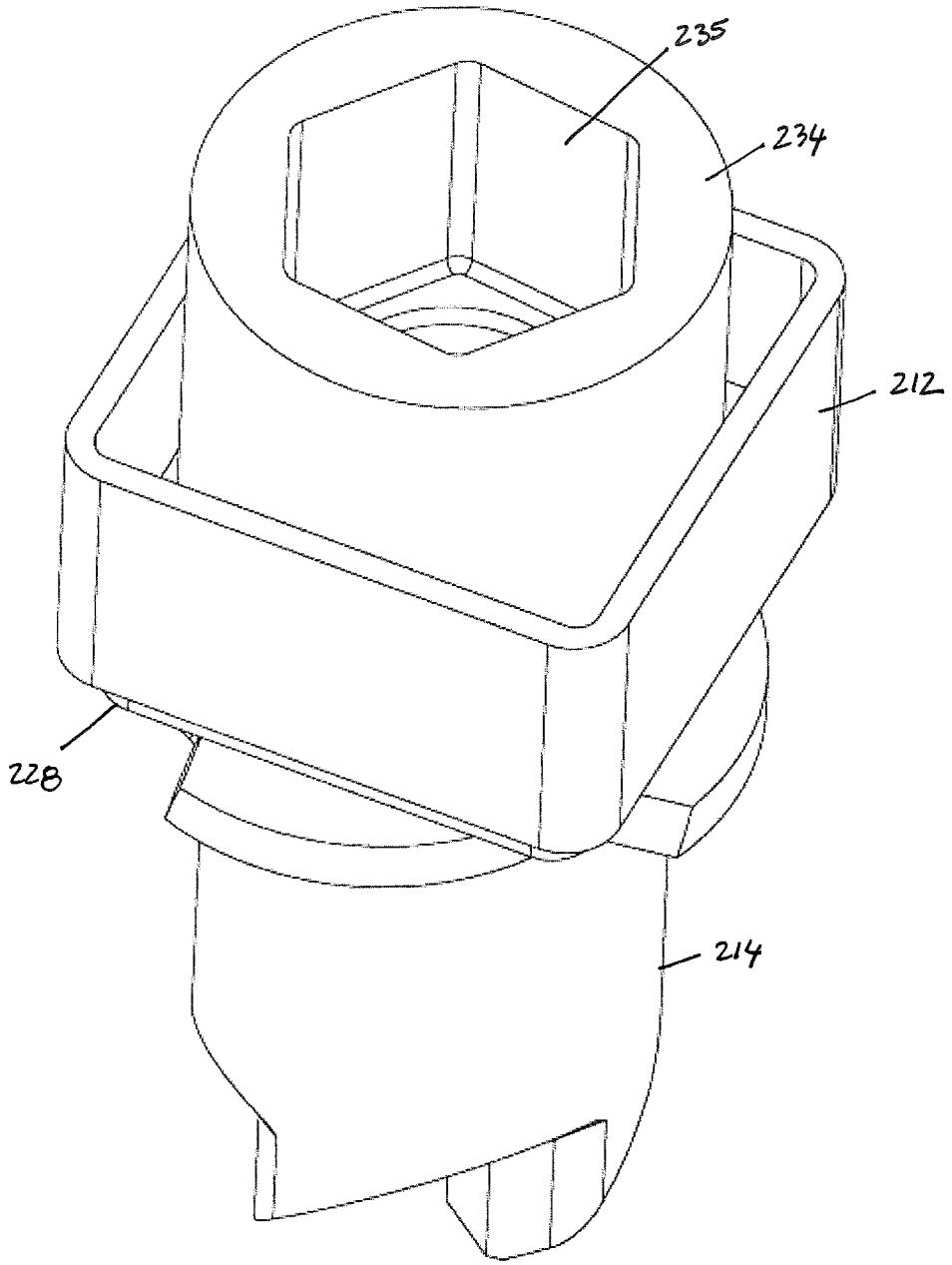
FIG. 12 shows a perspective view of a lower region of a screw pile in accordance with an embodiment of the present invention.
Figure 13:
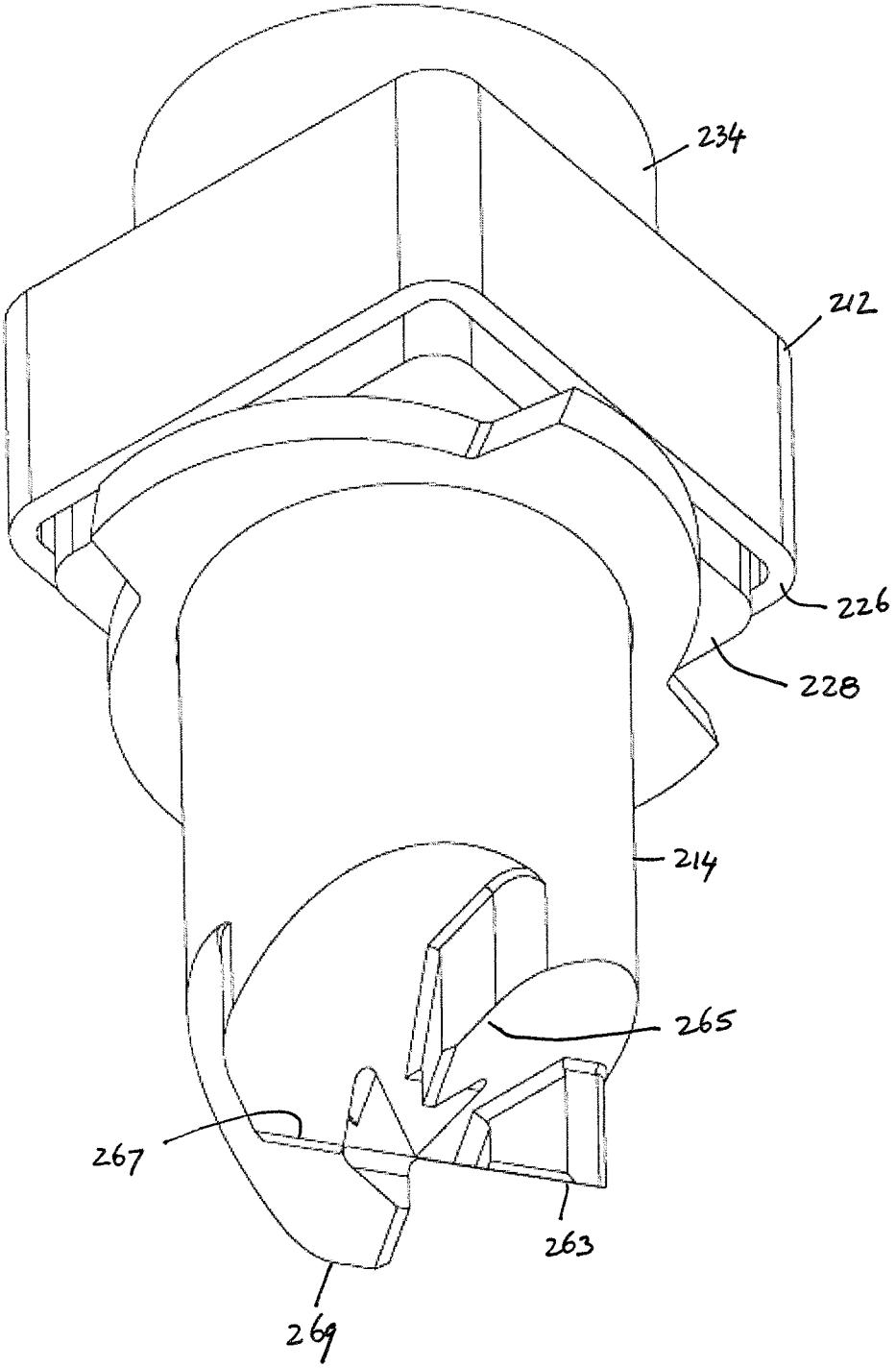
FIG. 13 shows a perspective view from below of the lower region of the screw pile shown in FIG. 12.
Figure 14:
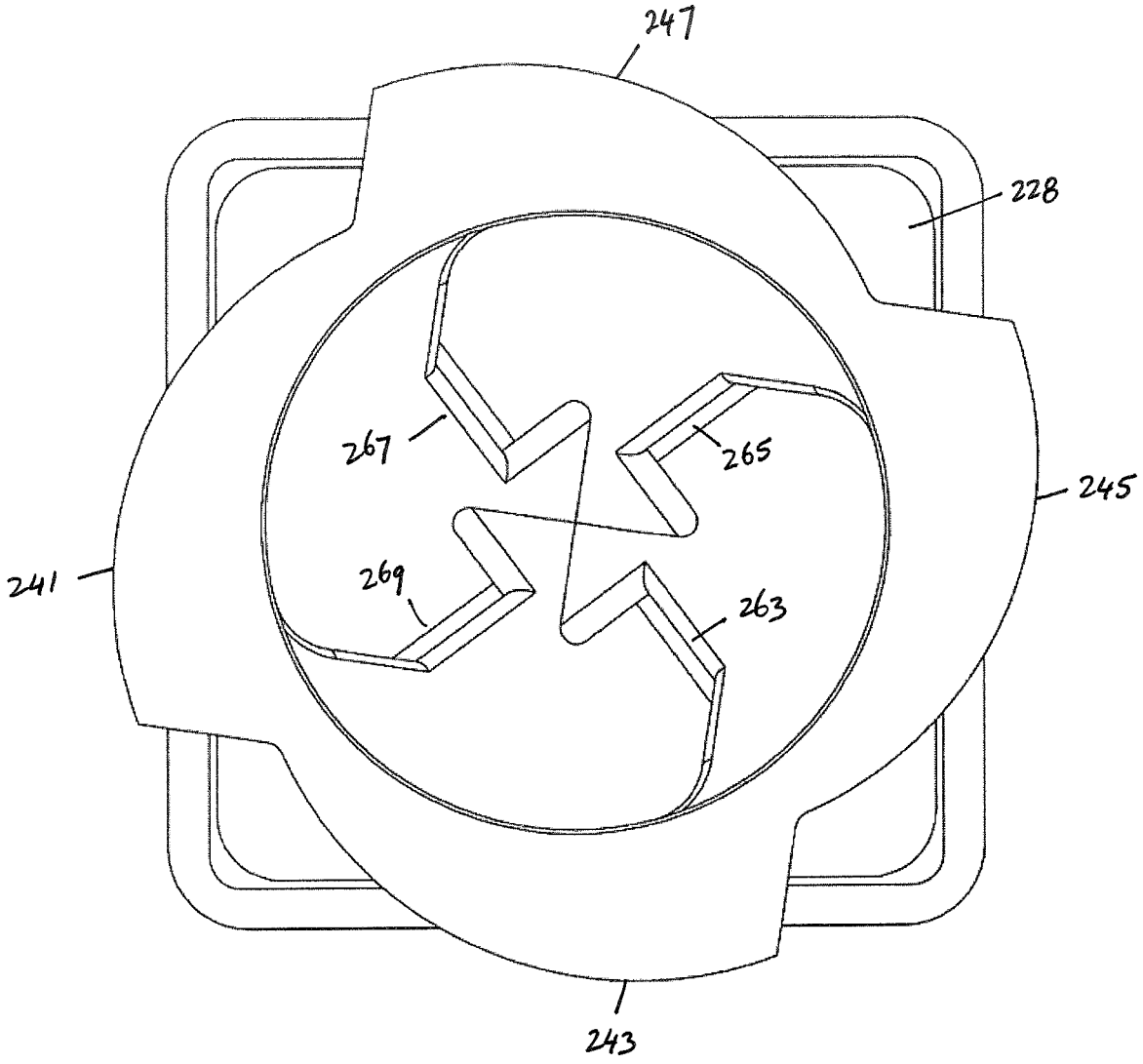
FIG. 14 shows an underneath view of the lower region of the screw pile shown in FIG. 12.
Figure 15:
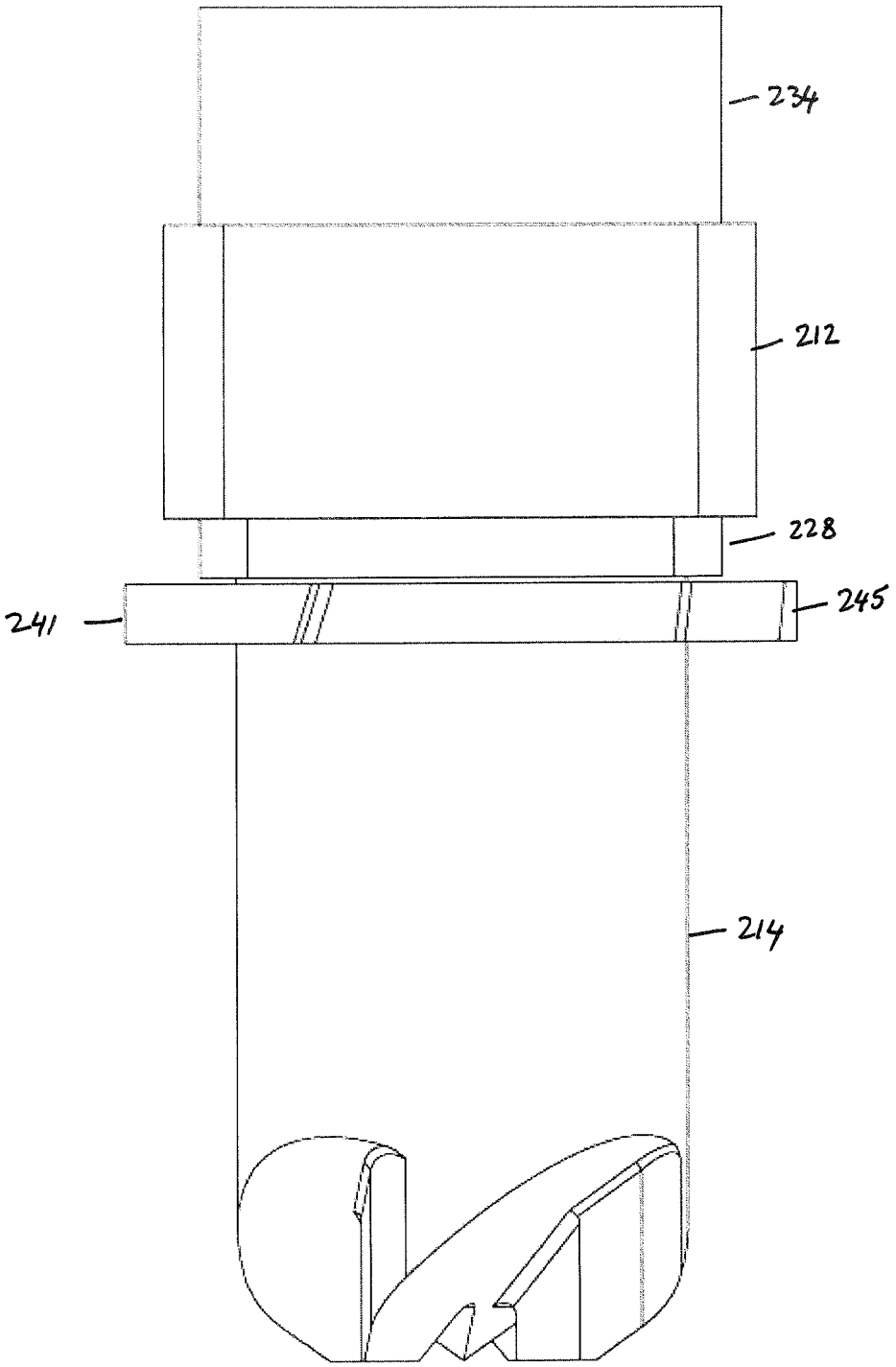
FIG. 15 shows a side view of the lower region of the screw pile shown in FIG. 12.

FIGS. 10 and 11 show perspective views of a screw pile 100 in accordance with another embodiment of the present invention. The screw pile 100 comprises a square hollow section (SHS) shaft 102 having a rotatable lower portion, generally referred to at reference numeral 104, mounted thereto. The rotatable section 104 includes a first blade 106, second blade 108 and a bit 110. The screw pile 100 is of generally similar construction to the screw pile 10 shown in FIG. 1.

The screw pile 100 also includes two stabilising wings 112, 114. As can be seen from FIG. 10, the stabilising wings 112, 114 are mounted to side face 103 of the SHS shaft 102. This means that the stabilising wings 112, 114 are offset from the centre or the longitudinal axis of the shaft 102. This location of stabilising wings may be required in order to ensure compatibility with some handling systems.

FIGS. 12 to 15 show various views of a lower part of a screw pile in accordance with another embodiment of the present invention. In FIGS. 12 to 15, the features of the screw pile have a number of features in common with the embodiment shown in FIGS. 1 to 8. For the sake of convenience, like features would be denoted using the same reference numerals as used in FIGS. 1 to 8, but with the addition of a "2" to the front. For example, main shaft 12 of FIG. 1 corresponds to main shaft 212 in FIGS. 12 to 15.

Further, in FIGS. 12 to 15, the blades that are connected to the rotatable lower part 214 of the screw pile have been omitted for clarity.

The differences between the embodiment shown in FIGS. 12 to 15 and the embodiment shown in FIGS. 1 to 8 is in the embodiment shown in FIGS. 12 to 15 include a hexagonal drive socket 235 in the upper part of the hub 234. Using a hexagonal drive socket allows for greater torque levels to be achieved when compared with conventional screw piles in the past. The hexagonal drive socket 235 will, of course, be driven by a hexagonal driveshaft on a drive tool.

The upper part of the rotating lower member 214 is also provided with a series of projections 241, 243, 245, 247. These projections may have an elliptical outer shape. As the rotatable lower portion 214 is rotated during insertion of the screw pile into the ground, the projections assist in sweeping away material and debris from the upper part of the lower rotatable part 214. As can be seen from FIG. 15, the projections are located near the junction between the lower rotatable portion 214 and the lower portion 226 of the shaft 212.

The attack bit at the lower end of the rotatable portion 214 is also different. The attack bit includes a pyramidal central region 261 and a plurality of cutting teeth, 263, 265, 267, 269. The attack bit shown in FIGS. 12 to 15 is suitably a forged attack tip that ensures perfect centre positioning (assisted by the central pyramid cutting point) during installation and with the added rock cutting teeth, able to cut through weathered rock via the 4 rotating cutting/deflection teeth.

Figure 16:
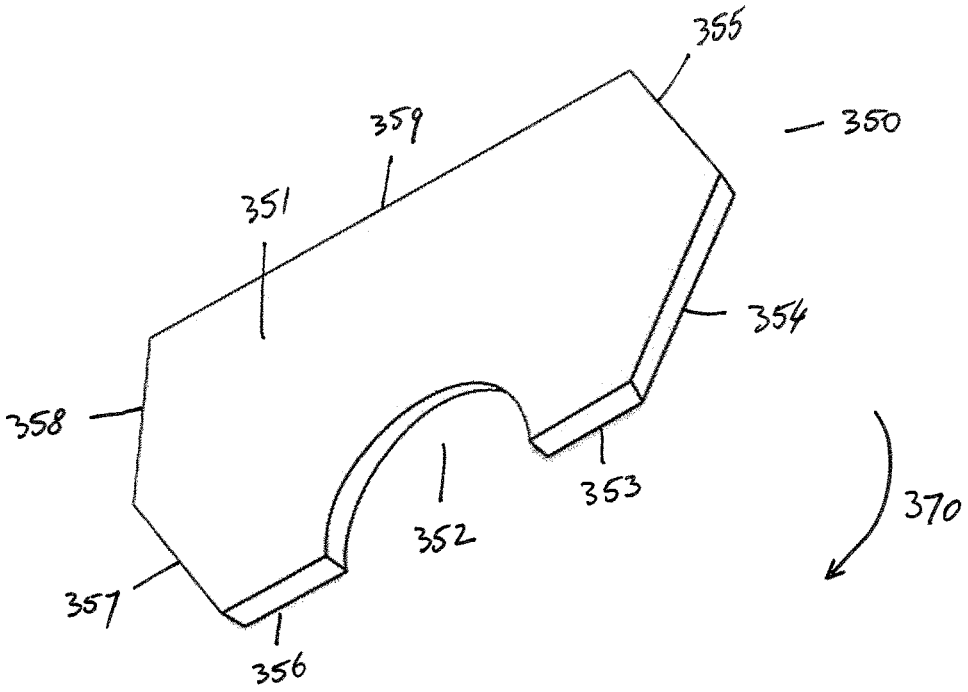
FIG. 16 shows a perspective view of a blade suitable for use in the screw pile in accordance with the present invention.

FIG. 16 shows a perspective view of a blade that may be used in place of the blades 16, 18 shown in FIG. 1. The blade 350 is made from a plate 351, typically a steel plate. The plate 351 is normally cut to shape from a larger plate.

The blade 350 has an arcuate cut-out 352 that is shaped such that the blade can snugly fit onto the circumference of the cylindrical shaft of the screw pile, with the arcuate cut-out 352 being shaped so that the blade is also positioned at the correct angle relative to the lower portion.

The blade 350 has a first leading edge 353, a second leading edge 354 and a third leading edge 355. The first leading edge 353 extends outwardly from the shaft. The first leading edge 353 is of relatively short length. The second leading edge 354 extends from the first leading edge 353. The second leading edge 354 extends outwardly from the shaft and forwardly relative to the direction of rotation. The direction of rotation during insertion of the screw pile in the ground is shown by arrow 370. The blade 350 includes a third leading edge 355. The third leading edge 355 extends from second leading edge 354. Third leading edge 355 extends outwardly from the shaft and rearwardly relative to the direction of rotation.

The blade 350 also includes a first trailing edge 356 that extends in a radial direction from the shaft of the screw pile. A second leading edge 357 extends from the first leading edge 356 and outwardly from the shaft of the screw pile and rearwardly of the direction of rotation. A third trailing edge 358 extends from the second trailing edge. The third trailing edge extends outwardly from the shaft and forwardly relative to the direction of rotation. A side edge 359 extends between the third leading edge 355 and the third trailing edge 358.

The blade 350 is generally hexagonal in shape, except for the cut-out region 352. The first leading edge 353 and first trailing edge 356 are relatively short. The second leading edge 354 and third leading edge 355 are longer than the first leading edge 354. The second leading edge 354 and the third leading edge 355 are of essentially identical length to each other. The trailing edges 356, 357 and 358 have similar lengths to the corresponding leading edges. The side edge 359 is significantly longer than each of the individual first leading edge 353, the second leading edge 354 and the third leading edge 355.

The blades 350 may have flat edges, as shown in the attached drawings. Alternatively, in some embodiments, the edges may be bevelled or sharpened to assist the blades in cutting through difficult ground conditions during insertion of the screw pile into the ground.

In the present specification and claims (if any), the word 'comprising' and its derivatives including 'comprises' and 'comprise' include each of the stated integers but does not exclude the inclusion of one or more further integers.

Reference throughout this specification to 'one embodiment' or 'an embodiment' means that a particular feature, structure, or characteristic described in connection with the embodiment is included in at least one embodiment of the present invention. Thus, the appearance of the phrases 'in one embodiment' or 'in an embodiment' in various places throughout this specification are not necessarily all referring to the same embodiment. Furthermore, the particular features, structures, or characteristics may be combined in any suitable manner in one or more combinations.

In compliance with the statute, the invention has been described in language more or less specific to structural or methodical features. It is to be understood that the invention is not limited to specific features shown or described since the means herein described comprises preferred forms of putting the invention into effect. The invention is, therefore, claimed in any of its forms or modifications within the proper scope of the appended claims (if any) appropriately interpreted by those skilled in the art.

The invention claimed is:

1. A screw pile for placement in ground, comprising a hollow elongate shaft, a lower portion rotatably mounted to the hollow elongate shaft, the lower portion carrying a screw or one or more blades or plates for screwing of the screw pile into the ground and a connector, the connector being joined to the lower portion, the connector having a portion that is retained within the hollow elongate shaft, the connector being rotatable relative to the hollow elongate shaft.

2. A screw pile as claimed in claim 1 comprising the hollow elongate shaft, the lower portion comprising a member being located below the hollow elongate shaft, the member having the screw, one or more blades or one or more plates attached thereto, the member being rotatable relative to the hollow elongate shaft, the screw pile being arranged such that the member cannot be removed from the hollow elongate shaft, the screw pile being arranged such that the member cannot be removed from the screw pile by pulling the member away from the hollow elongate shaft.

3. A screw pile as claimed in claim 1 wherein the hollow elongate shaft comprises a shaft having a shape of a polygonal prism or a square hollow section rectangular hollow section.

4. A screw pile as claimed in claim 1 wherein the lower portion or a member located below the hollow elongate shaft has a circular cross-section for at least a part of its length.

5. A screw pile as claimed in claim 1 wherein the lower portion has a cylindrical shape.

6. A screw pile as claimed in claim 1 wherein the lower portion or a member being located below the hollow elongate shaft has one or more projections to sweep material away from an underside of the hollow elongate shaft or for removing material away from a region near an interface between the hollow elongate shaft and the lower portion during insertion of the screw pile into the ground.

7. A screw pile as claimed in claim 6 wherein the one or more projections comprise one or elliptical protrusions located towards a top part of the lower portion.

8. A screw pile as claimed in claim 1 comprising a first angled blade attached to the lower portion and a second angled blade attached to the lower portion.

9. A screw pile as claimed in claim 8 wherein each blade has an arcuate region or cut-out to enable the blades to be connected to a shaft of the screw pile, the blade comprising a first leading edge extending outwardly from the shaft, a second leading edge extending from the first leading edge and a third leading edge extending from the second leading edge, a first trailing edge extending from the shaft, a second trailing edge extending from the first trailing edge and a third trailing edge extending from the second trailing edge, and a side edge extending from the third leading edge to the third trailing edge, the trailing edges being a mirror image of the leading edges.

10. A screw pile as claimed in claim 8 wherein each blade has an arcuate region or cut-out to enable the blades to be connected to a shaft of the screw pile, each blade having a cutting region comprising a first leading edge extending radially outwardly from the shaft, a second leading edge extending from the first leading edge, the second leading edge extending outwardly from the shaft and forwardly relative to a direction of rotation during insertion of the screw pile, a third leading edge extending from the second leading edge, the third leading edge extending outwardly from the shaft and rearwardly relative to a direction of rotation during insertion of the screw pile, the blade further including a trailing region comprising a first trailing edge extending radially outwardly from the shaft, a second trailing edge extending from the first trailing edge, the second trailing edge extending outwardly from the shaft and rearwardly relative to a direction of rotation of the screw pile during insertion, and a third trailing edge extending from the second trailing edge, the third trailing edge extending outwardly from the shaft and forwardly relative to the direction of rotation of the screw pile during insertion, and a side edge extending between the third leading edge and a third trailing edge.

11. A screw pile as claimed in claim 1 wherein the screw pile includes one or more stabilising wings extending generally radially or transversely outwardly from the pile shaft.

12. A screw pile as claimed in claim 11 wherein the stabilising wings are in the form of plates extending in a direction that is generally transverse to the pile shaft, the stabilising wings having lower edges that extend at an acute angle to the longitudinal axis of the pile shaft.

13. A screw pile as claimed in claim 1 further comprising a bit or a rock attack section formed on or joined to a lower portion of the screw pile.

14. A screw pile for placement in ground, comprising a hollow elongate shaft, a lower portion rotatably mounted to the hollow elongate shaft, the lower portion carrying a screw or one or more blades or plates for screwing of the screw pile into the ground, wherein the lower portion comprises a cylindrical member or a cylindrical portion and the screw pile further comprises a hub.

15. A screw pile as claimed in claim 14 wherein the hub is connected to the cylindrical portion wherein the hub is rotatable relative to the hollow elongate shaft and fixed against rotation relative to the lower portion.

16. A screw pile as claimed in claim 14 wherein the hub is arranged to engage with a drive tool.

17. A screw pile as claimed in claim 16 wherein the hub has an opening that receives the drive tool or the hub has a projection that is surrounded by a drive element of the drive tool, or the hub has a drive socket, or the hub has a hexagonal drive socket.

18. A screw pile as claimed in claim 14 wherein the cylindrical portion has a diameter that is less than a width of the hollow elongate shaft.

19. A screw pile as claimed in claim 14 wherein the hub comprises a first cylindrical portion of a first diameter and a second cylindrical portion of a second diameter, the second diameter being less than the first diameter, the second cylindrical portion extending into the cylindrical portion of the pile, the first cylindrical portion being located within the hollow elongate shaft.

20. A screw pile as claimed in claim 14 wherein the hollow elongate shaft is fitted with a plate or a member having a complementary outer shape to an inner shape of the hollow elongate shaft, the plate or member including a circular opening through which at least part of the hub extends, the plate or member being connected to the hollow elongate shaft.

21. A screw pile for placement in ground, comprising a hollow elongate shaft, a lower portion rotatably mounted to the hollow elongate shaft, the lower portion carrying a screw or one or more blades or plates for screwing of the screw pile into the ground, wherein the screw pile comprises a hollow shaft having a polygonal prism shape and a lower cylindrical portion extending below a lower end of the hollow shaft, a plate having a complementary outer shape to an inner shape of the hollow shaft, the plate being joined to the hollow shaft at a lower end of the hollow shaft, the plate including a generally circular opening through which a hub can extend, the hub comprising a first cylindrical portion having a first diameter and a second cylindrical portion having a second diameter, the second diameter being smaller than the first diameter, the second cylindrical portion of the hub extending through the circular opening in the plate, the first cylindrical portion of the hub being positioned above the plate, the second cylindrical portion being joined to the cylindrical portion of the screw pile, the hub being arranged to engage with a drive tool, the cylindrical portion of the screw pile having a screw or one or more blades or one or plates attached thereto.

22. A screw pile as claimed in claim 21 wherein the hub can rotate relative to the plate whereby rotation of a drive tool that is engaged with the hub causes the lower cylindrical portion of the screw pile and the screw, blades or plates attached thereto to rotate.

23. A screw pile as claimed in claim 21 wherein a small gap is provided between an upper end of the lower cylindrical portion and the lower end of the plate, and wherein the lower cylindrical portion has a diameter that is larger than the second diameter such that an upper end of the lower cylindrical portion has walls that are positioned radially outwardly from the opening in the plate.

* * * * *